United States Patent [19]

Petrie

[11] Patent Number: 4,680,667

[45] Date of Patent: Jul. 14, 1987

[54] SOLENOID DRIVER CONTROL UNIT

[75] Inventor: Adelore F. Petrie, Arlington Heights, Ill.

[73] Assignee: Motorola, Inc., Schaumburg, Ill.

[21] Appl. No.: 778,997

[22] Filed: Sep. 23, 1985

[51] Int. Cl.[4] ..... F02D 41/30; H01H 47/32

[52] U.S. Cl. ..... 361/154; 123/490

[58] Field of Search ..... 361/154; 123/490

[56] References Cited

U.S. PATENT DOCUMENTS 4,327,394 4/1982 Harper ..... 361/154

4,605,983 8/1986 Harvey ..... 361/154

*Primary Examiner*—Michael L. Gellner

*Attorney, Agent, or Firm*—Steven G. Parmelee

[57] ABSTRACT

A solenoid driver control circuit for use with solenoids, the circuit including a current sense unit (12) for providing a current sense signal and a solenoid drive unit (13) for selectively allowing current to flow through the solenoid (11) from a power source (14). The circuit also includes a threshold comparator unit (17) for comparing threshold signals with the current sense signal and for providing an output signal that can control the solenoid drive unit (13), a minimum threshold unit (18) for providing a minimum threshold, a maximum threshold unit (19) for initially providing a maximum threshold until a peak current flow through the solenoid (11) has been established, a first timing unit (21) to periodically provide increased threshold signals for specified durations of time, and a second timing unit (41) for initially providing an increased minimum threshold signal at the outset of a control cycle. The device provides a minimum current flow through the solenoid (11) at all times during a control cycle and utilizes time control to realize the desired solenoid current waveform.

16 Claims, 6 Drawing Figures

SOLENOID DRIVER CONTROL UNIT

TECHNICAL FIELD

This invention relates generally to solenoid controls, and more particularly to electronic controls as used with fuel injection solenoid valves.

BACKGROUND ART

Many internal combustion engines utilize fuel injectors to introduce combustible fluids into the intake manifolds or combustion chambers of the engine. Electronic controls are often utilized to govern operation of the fuel injectors. To allow appropriate interaction between the injector valve structure and the electronic controls, such injectors typically include a solenoid operated valve that can respond to electric signals from the electronic controls.

The electronic controls for such prior art fuel injector systems generally include a current sense unit that can provide a signal indicative of the level of current flowing through the injector solenoid. An injector drive control unit receives these signals and injection command signals and determines when to apply power to the injector solenoid. The injector drive control unit can then apply a drive signal when appropriate to an injector drive unit. The injector drive unit operates to selectively allow current to flow from a power source (such as a battery) through the injector solenoid and the injector drive unit.

Such prior art systems also usually include a flyback control unit. Although current flow through an inductor cannot be halted in an instant, the flyback control unit provides a means for the stored energy in the solenoid coil to be quickly dissipated and thereby assure a speedy response of the injector valve itself.

These prior art injector drive control units typically operate by comparing the current sense signal with a threshold signal. The threshold signal can usually be varied to provide for both a peak initial current and a lower subsequent holding current. Many of these devices also operate to switch the injector drive unit on and off in planned succession to maintain the solenoid current within either a peak current range or holding current range.

Depending upon the dynamics and operating means of the fuel injection system in question, some of these prior art solutions may not be appropriate. For example, there exists a need for an injector driver control unit that can maintain a minimum solenoid current during both the peak and holding current phases, while also using time as an operative control parameter to ensure the creation and maintenance of the desired control waveform.

SUMMARY OF THE INVENTION

These needs and others are substantially met through provision of the solenoid driver control unit disclosed in this specification. This solenoid driver control unit operates in conjunction with a solenoid drive unit that can be selectively controlled to allow current to flow through a solenoid from a power source, and a current sense unit that can provide a current sense signal indicative of the level of current flowing through the solenoid. The solenoid driver control unit includes generally a threshold comparator unit, a minimum threshold unit, a maximum threshold unit, and a timing unit.

The threshold comparator unit serves to compare at least one threshold signal with the current sense signal provided by the current sense unit and, based upon this comparison, provide output signals that control the injector drive unit. The minimum threshold unit assures provision of at least a minimum threshold signal to the threshold comparator unit. The maximum threshold unit initially provides a maximum threshold signal to the threshold comparator unit to ensure an initial flow of peak current through the solenoid. The maximum threshold unit responds to the threshold comparator unit so that provision of the maximum threshold signal ceases once current through the solenoid at least equals a preselected peak current.

The timing unit also responds to the threshold comparator unit and causes the threshold comparator unit to provide an "on" signal to the solenoid drive unit for a specified period of time subsequent to the current through the solenoid at least equalling the preselected peak current, such that current will flow through the solenoid from the power source during this specified period of time substantially regardless of the rise of current flow through the solenoid.

In one embodiment, the current sense unit can be provided through use of a series connected resistor, and the threshold comparator unit can be comprised of a comparator having a first input connected to receive the current sense signal and a second input for receiving the threshold signals. The minimum threshold unit can be comprised of a resistor biased by a set voltage to thereby provide a minimum threshold signal. The maximum threshold unit can be comprised of a flip-flop, the Q output of which connects through a resistor to the threshold input of the comparator to thereby provide a maximum threshold signal when present. The timing unit can be comprised of a monostable one shot that also has its Q output connected through a resistor to the threshold input of the comparator. So long as the output of the monostable has a high state, yet another threshold signal will be applied to the threshold input.

Through use of the above described embodiment, current through the solenoid will first rise to a peak current, such as 4 amperes. Upon attaining this peak, current will then decay to a minimum holding current level as established by the minimum threshold unit. Current will then rise as the timing unit maintains the output of the comparator high for a set period of time. The timing unit accomplishes this by effectively raising the threshold provided to the threshold input of the comparator. At the conclusion of its timing cycle, the timing unit will remove this threshold signal, thereby lowering the threshold signal at the threshold input of the comparator. As a result, the current sense signal will now exceed the threshold signal, and the comparator will switch the solenoid drive unit off. Current flow through the solenoid will then again decay to the minimum threshold level, where the monostable will again trigger. The above sequence will continue until the conclusion of the control cycle.

In another embodiment, a flyback control unit may be provided to ensure appropriate decay response both during the control cycle and at the conclusion of the control cycle. Further, a control logic unit can be provided to cause the solenoid drive unit to be controllable as a function of both the output of the threshold comparator unit and the presence of an input control signal.

In yet another embodiment, a second timing unit can be provided that responds to an input control signal for providing yet another threshold signal to the threshold input of the threshold comparator unit during a second predetermined time period. So configured, the second timing unit will become operational at the outset of a control cycle, thereby providing a higher minimum threshold signal during the initial phase of a control cycle to effectively increase the duration of the peak current phase (also known as the pull-in current phase). Although the current flow will be switched on and off as described above with respect to the holding current phase, the switching will now occur at higher current levels due to the influence of the threshold signal introduced by the second timing unit until the second timing unit times out.

BRIEF DESCRIPTION OF THE DRAWINGS

These and other attributes of the invention will become more clear upon making a thorough review and study of the following description of the best mode for carrying out the invention, particularly when reviewed in conjunction with the drawings, wherein.

BEST MODE FOR CARRYING OUT THE INVENTION

Figure 1:
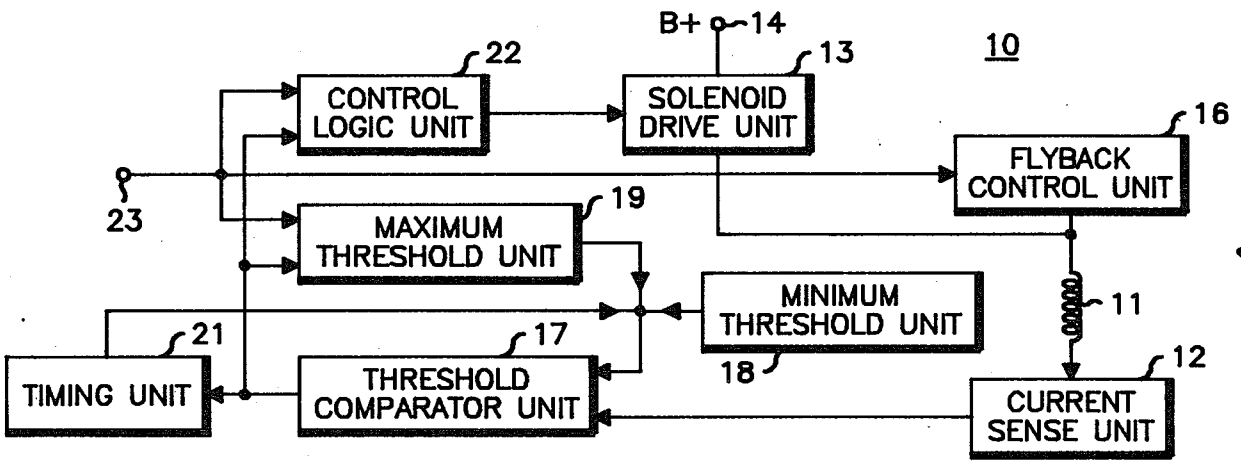
FIG. 1 comprises a block diagram view of a first embodiment.

Referring now to the drawings, and in particular to FIG. 1, the device can be seen in block diagram form as depicted generally by the numeral 10. The device (10) operates in conjunction with a solenoid (11), a current sense unit (12), a solenoid drive unit (13), a power source (14), and a flyback control unit (16). The device (10) includes generally a threshold comparator unit (17), a minimum threshold unit (18), a maximum threshold unit (19), a timing unit (21), a control logic unit (22), and a control signal input unit (23). Each of these components will now be described in more detail in seriatim fashion.

Figure 2:
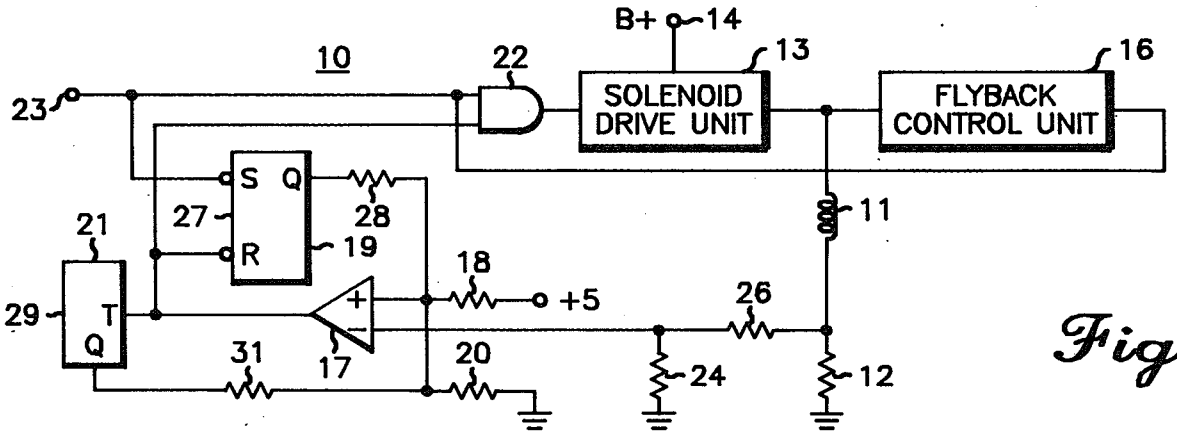
FIG. 2 comprises a schematic diagram of the first embodiment.

Referring to FIG. 2, the solenoid (11) can be comprised (for purposes of example) of a fuel injector solenoid. The current sense unit (12) can be comprised of a grounded low ohmage resistor connected in series with the solenoid (11). If necessary, a voltage divider network comprised of two resistors (24 and 26) can be connected to the current sense resistor to bias the current sense signal as desired for ensuring subsequent compatible processing. The solenoid drive unit (13) connects between the power source (14) (such as a battery) and the solenoid (11). Such solenoid drive units (13) are well understood in the art, and hence no more detailed description of the unit need be provided here. Similarly, the flyback control unit (16) connects as indicated, with such flyback control units being well understood by those skilled in the art such that no more detailed description of the unit need be provided here.

The threshold comparator unit (17) can be comprised of a two input comparator. The inverting input of this comparator connects to receive the current sense signal from the current sense unit (12). The noninverting input comprises a threshold input, and this threshold input connects as described below. The output of the comparator connects to the maximum threshold unit (19), the timing unit (21), and the control logic unit (22), also as described below in more detail.

The minimum threshold unit (18) may be comprised of a resistor that connects between the threshold input of the comparator and a voltage source, such as a positive five volt source. So configured, the minimum threshold unit (18) will ensure that at least a minimum threshold signal will always be applied to the noninverting input of the threshold comparator unit (17) If desired, a grounded resistor (20) can also be connected to the noninverting input of the threshold comparator unit (17) to ensure a minimum threshold signal of adequate magnitude.

The maximum threshold unit (19) may be comprised of a flip-flop (27) and a resistor (28), the resistor (28) connecting between the Q output of the flip-flop (27) and the threshold input of the comparator (17). The reset port of the flip-flop (27) connects to the output of the threshold comparator unit (17) and the set port connects to the control signal input (23). So configured, the flip-flop (27), having been set before the initiation of a control signal pulse, causes the output signal at the Q output to be high, thereby causing a maximum threshold signal to be applied to the threshold input of the threshold comparator unit (17). When the output of the threshold comparator unit (17) goes low, this, in turn, will reset the flip-flop (27) and remove the maximum threshold signal from the threshold input.

The timing unit (21) includes a monostable one shot (29) and a resistor (31), the resistor (31) connecting between the Q output of the monostable (29) and the threshold input of the threshold comparator unit (17). The trigger input of the monostable (29) connects to the output of the threshold comparator unit (17). So configured, a high output from the threshold comparator unit (17) will trigger the monostable (29) and cause a time duration threshold signal to be applied to the threshold input of the threshold comparator unit (17), thereby effectively raising the threshold signal well above the minimum threshold signal provided by the minimum threshold unit (18). At the conclusion of the timing cycle for the timing unit (21), this increased threshold signal will be removed from the threshold input, causing the output of the threshold comparator (17) to go low.

The control logic unit (22) can be comprised of an AND gate having one input connected to the output of the threshold comparator unit (17) and one input connected to receive the control signal via the control signal input (23). The output of the AND gate connects to drive the solenoid drive unit (13). So configured, the control logic unit (22) will only provide an enabling output to the solenoid drive unit (13) in the presence of both the control signal and a high output signal from the threshold comparator unit (17).

Figure 3:
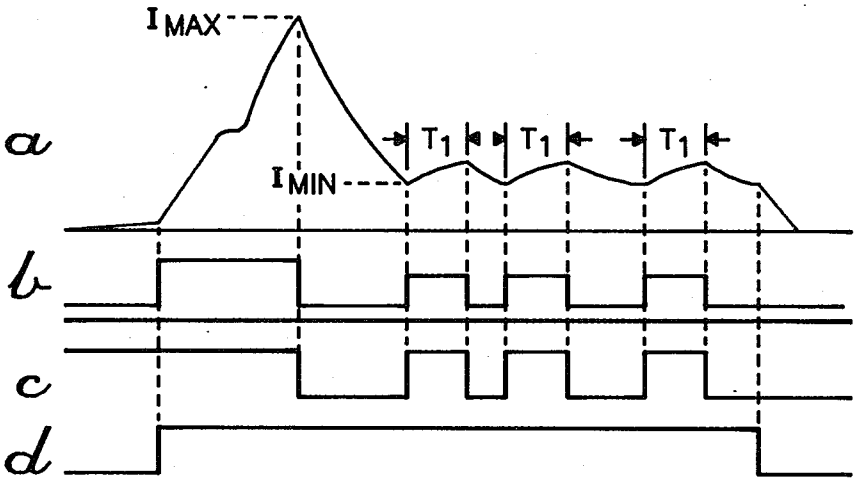
FIG. 3 comprises waveform diagrams depicting operation of the first embodiment.

With reference to FIG. 3, the threshold signals as provided to the threshold input of the threshold comparator unit (17) are depicted in FIG. 3*b*. The initial level for the threshold signal comprises a maximum, as established on the maximum threshold unit (19). Subsequent increased threshold signals as provided by the timing unit (21) are not necessarily as high, though they could be as high or higher if desired. It may be noted that the threshold level never drops to zero, but instead remains at no less than a minimum threshold level as established by the minimum threshold unit (18).

The output state of the threshold comparator unit (17) can be seen in FIG. 3*c*. The control signal as provided to the control signal input (23) has been set forth in FIG. 3*d*. The resulting level of current flow through the solenoid (11) can be viewed in FIG. 3*a*, where it can be seen that current flow first attains a peak ($I_{max}$) and then drops to a minimum ($I_{min}$), the former being established by the maximum threshold unit (19) and the latter being established by the minimum threshold unit (18). The subsequent rises in current flow are uniform with respect to time duration ($T_1$) as established by the timing unit (21).

Through use of this embodiment, current flow through the solenoid will always be maintained at least at a minimum level, and time plays an important role in assuring the formation of the waveforms depicted.

Figure 4:
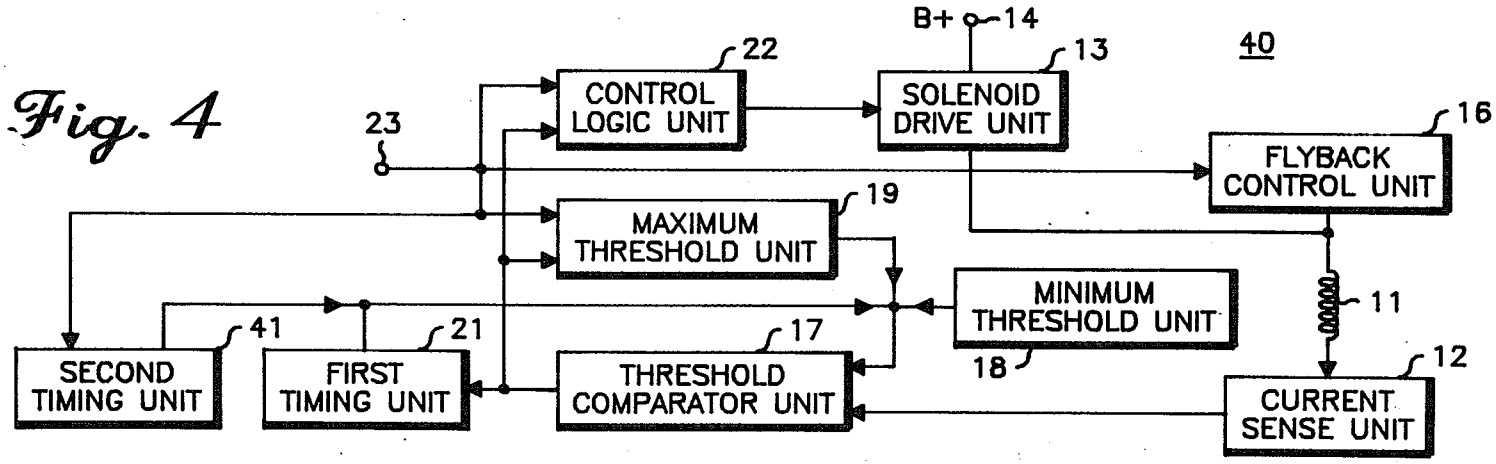
FIG. 4 comprises a block diagram view of a second embodiment.
Figure 5:
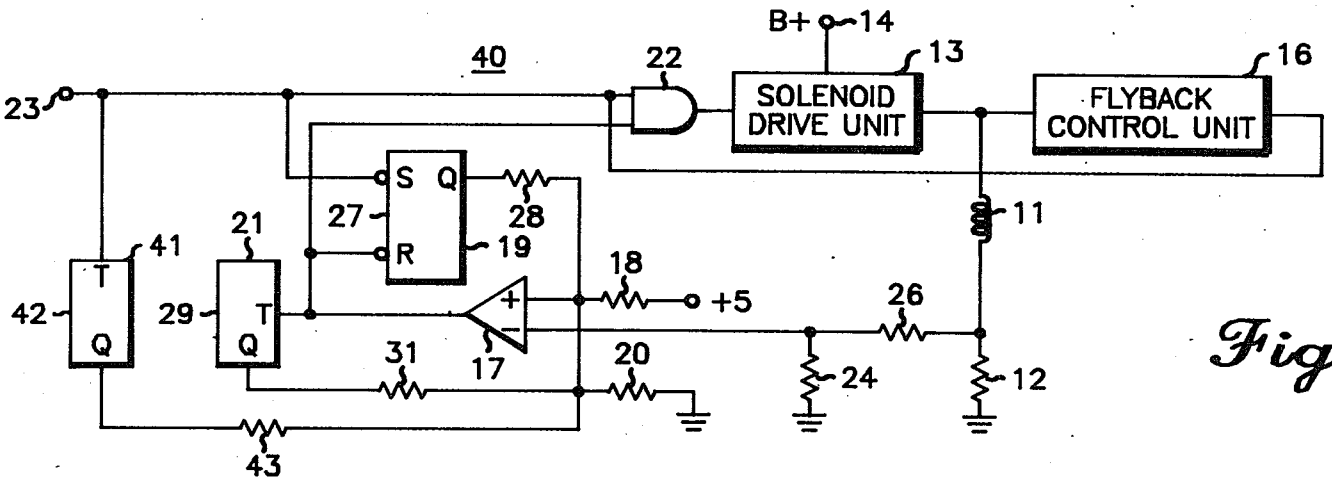
FIG. 5 comprises a schematic diagram of the second embodiment.

Referring now to FIG. 4, an alternative embodiment can be seen as depicted generally by the numeral 40. This embodiment (40) retains all of the components described above with respect to the first embodiment (10), and like numerals are used to denote like components. In addition, the second embodiment (40) includes a second timing unit (41). With reference to FIG. 5, the second timing unit (41) can be comprised of a second monostable one shot (42) and a resistor (43). The trigger input to the monostable (42) connects to receive the control signal via the control signal input (23). The Q output of the monostable (42) connects through a resistor (43) to the threshold input of the threshold comparator unit (17). So configured, the second timing unit (41) will provide an increased threshold signal to the threshold comparator unit (17) during the initial portion of a control cycle. This increased signal will remain until the second monostable (42) concludes its timing cycle.

Figure 6:
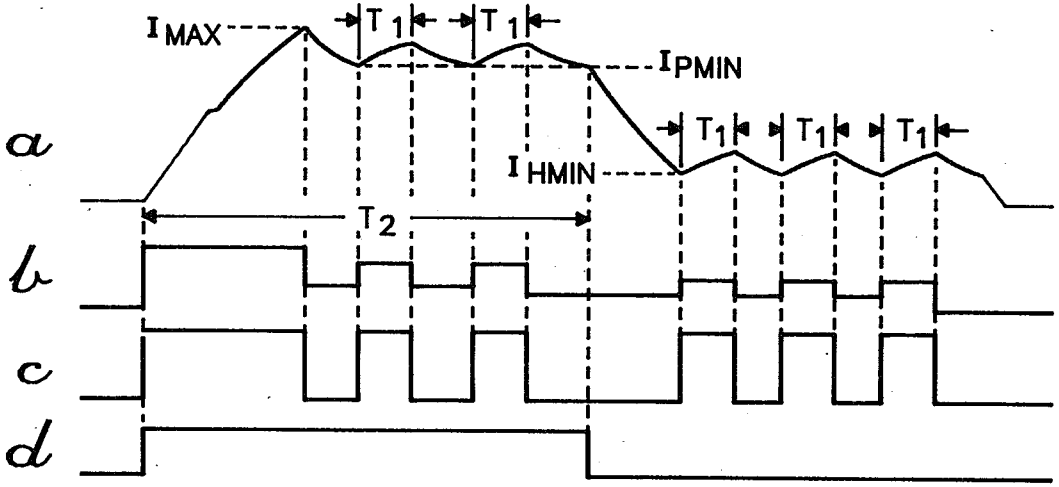
FIG. 6 comprises waveform diagrams depicting operation of the second embodiment.

With reference to FIG. 6, the threshold signal level as provided to the threshold comparator unit (17) can be seen at FIG. 6*b*. The initial threshold constitutes a maximum level and coincides with the threshold signal provided by the maximum threshold unit (19) in combination with the second timing unit (41). When the solenoid current flow reaches its peak ($I_{max}$) (see FIG. 6*a*), the threshold will drop to a minimum peak threshold as established by the second timing unit (41). When the current flow decays to the minimum peak level ($I_{pmin}$)(see FIG. 6*a*), the threshold comparator unit (17) will provide a high signal to switch the current flow back on and simultaneously trigger the first timing unit (21) to cause provision of an increased threshold signal to the threshold comparator unit (17) during the duration of the timing cycle for the first timing unit (21). This process will repeat until the timing cycle ($T_2$) for the second timing unit (41) concludes. (Following this, the operation of the second embodiment (40) for the holding current phase of the control cycle will essentially duplicate the operation described above with respect to the first embodiment (10)).

To aid in understanding operation of the second embodiment (40), FIG. 6*c* comprises a waveform depicting the output state of the threshold comparator unit (17), FIG. 6*d* comprises the output state of the second timing unit (41), and FIG. 6*a* comprises a waveform depicting current flow through the solenoid (11).

Through use of this second embodiment (40), minimum current levels are again maintained while time serves an important function in assuring the formation and maintenance of the waveform depicted.

Those skilled in the art will recognize that many modifications and variations could be made with respect to the embodiments described above. Such modifications and variations are not to be considered as outside the scope of the claims, unless the claims include specific limitations to this effect.

I claim:

1. In a solenoid driver control circuit having a control signal input for receiving a control signal, current sense means for providing a current sense signal indicative of current flowing through a solenoid, solenoid drive means for selectively allowing current to flow through said solenoid from a power source, and threshold comparator means for comparing at least one threshold signal with said current sense signal and for providing an output signal in response thereto to control said solenoid drive means, an improvement comprising:

(a) minimum threshold means for providing a minimum threshold to said threshold comparator means;

(b) maximum threshold means for initially providing a maximum threshold to said threshold comparator means at the initiation of said control signal, said maximum threshold means being responsive to said threshold comparator means to only provide said maximum threshold to said threshold comparator means until said current through said solenoid at least equals a preselected peak current; and (c) timing means responsive to said threshold comparator means for causing said threshold comparator means to provide said output signal to said solenoid drive means for a specified period of time subsequent to said current through said solenoid at least equalling said preselected peak current, such that current will flow through said solenoid from said power source during said specified period of time.

2. The improvement of claim 1 wherein said timing means provides a timing duration threshold to said threshold comparator means during said specified period of time.

3. The improvement of claim 2 wherein said output signal from said threshold comparator means will cease, even during said specified period of time, if current flow through said solenoid provides a current sense signal that exceeds said timing duration threshold.

4. The improvement of claim 2 wherein said timing means comprises a one shot, the output of which selectively biases a threshold input for said threshold comparator means.

5. The improvement of claim 1 wherein said maximum threshold means comprises a flip-flop having an output operatively connected to said threshold comparator means.

6. The improvement of claim 5 wherein said flip-flop has a set input operatively connected to said control signal input and a reset input connected to receive said output signal from said threshold comparator means.

7. The improvement of claim 1 and further including control logic means operatively connected between said solenoid drive means and said threshold comparator means for controlling when said threshold comparator means can operate said solenoid drive means.

8. The improvement of claim 7 wherein said control logic means is enabled by presence of said control signal.

9. The improvement of claim 8 wherein said control logic means comprises an AND gate having one input connected to receive said control signal and a second input connected to receive said output signal from said threshold comparator means.

10. In a solenoid driver control circuit having current sense means for providing a current sense signal indicative of current flowing through a solenoid, solenoid drive means for selectively allowing current to flow through said solenoid from a power source, and threshold comparator means for comparing at least one threshold signal with said current sense signal and for providing an output signal in response thereto to control said solenoid drive means, an improvement comprising:

(a) minimum threshold means for providing a minimum threshold to said threshold comparator means;

(b) maximum threshold means for initially providing a maximum threshold to said threshold comparison means, said maximum threshold means being responsive to said threshold comparator means to only provide said maximum threshold to said threshold comparator means until said current through said solenoid at least equals a preselected peak current level;

(c) first timing means responsive to said output signal from said threshold comparator means to provide a first timing duration threshold to said threshold comparator means for a first time period subsequent to said maximum threshold for causing said threshold comparator means to provide said output signal during said first time period; and (d) second timing means for providing a second timing duration threshold to said threshold comparator means for a second time period.

11. The improvement of claim 10 wherein said first timing means comprises a first one shot, the output of which selectively biases a threshold input for said threshold comparator means.

12. The improvement of claim 11 wherein said first one shot has a trigger input responsive to said output signal of said threshold comparator means.

13. The improvement of claim 10 wherein said second timing means comprises a second one shot, the output of which selectively biases the threshold input for said threshold comparator means.

14. The improvement of claim 13 wherein said solenoid driver control circuit includes a control signal input for receiving a control signal and wherein said second one shot includes a trigger input for receiving said control signal, said second one shot being responsive to said control signal.

15. The improvement of claim 10 wherein said first timing means comprises a first one shot, the output of which selectively biases a threshold input for said threshold comparator means, and wherein said second timing means comprises a second one shot, the output of which selectively biases a threshold input for said threshold comparator means.

16. The improvement of claim 15 wherein said solenoid driver control circuit further includes a control signal input for receiving a control signal, and wherein said first and second one shots each include a trigger input, said trigger input for said first one shot being connected to receive said output signal from said threshold comparator means and said trigger input for said second one shot being connected to operably receive said control signal.

* * * * *